United States Patent [19]

Nishida et al.

[11] Patent Number: 4,695,758

[45] Date of Patent: Sep. 22, 1987

[54] SMALL-SIZED SPARK PLUG HAVING A SPARK GAP PARALLEL TO AN AXIS RUNNING THROUGH THE CENTER ELECTRODE

[75] Inventors: Minoru Nishida; Tadashi Hattori, both of Okazaki; Kunimasa Yoshimura, Mishima; Tetsuzo Muraki, Hamamatsu, all of Japan

[73] Assignees: Nippondenso Co., Ltd., Kariya; Toyota Jidosha Kabushiki Kaisha, Toyota; Nippon Soken, Inc., Nishio, all of Japan

[21] Appl. No.: 758,415

[22] Filed: Jul. 24, 1985

[30] Foreign Application Priority Data

Jul. 25, 1984 [JP] Japan ..... 59-155046
Jul. 25, 1984 [JP] Japan ..... 59-155047

[51] Int. Cl.[4] ..... H01T 13/20

[52] U.S. Cl. ..... 313/130; 313/138; 313/142

[58] Field of Search ..... 313/130, 131 R, 138, 313/139, 141, 143

[56] References Cited

U.S. PATENT DOCUMENTS 1,962,669 6/1934 Parkin, Jr. ..... 123/169
3,313,972 4/1967 Beesch ..... 313/130
3,538,372 11/1970 Terao et al. ..... 313/131
3,558,959 1/1971 Ziemendorf ..... 313/130
4,110,667 8/1978 Graf Vom Hagen ..... 313/139 X
4,219,003 8/1980 Sato et al. ..... 313/138 X
4,329,615 5/1982 Tanaka et al. ..... 313/141

*Primary Examiner*—David K. Moore
*Assistant Examiner*—K. Wieder
*Attorney, Agent, or Firm*—Cushman, Darby & Cushman

[57] ABSTRACT

A small-sized spark plug for internal combustion engines is disclosed which is composed of a center electrode having a shaft portion surrounded by an insulator layer and a terminal end portion adapted to act as a spark generation portion; and an earthed electrode having a terminal end portion which is spaced apart from and is opposite to the terminal end portion of the center electrode so that a spark gap is defined along a surface of the insulator layer. The shortest distance $\delta$ (mm) between each end portion of the two electrodes and the surface of the insulation layer and the distance l between the forward end portions of the two electrodes have the following relationship:

$$\delta \geqq 0.25\ l, \text{ and } 0.8\ \text{mm} \leqq l \leqq 2.0\ \text{mm}.$$

A recessed portion may be provided on the surface of the insulation layer.

12 Claims, 12 Drawing Figures

SMALL-SIZED SPARK PLUG HAVING A SPARK GAP PARALLEL TO AN AXIS RUNNING THROUGH THE CENTER ELECTRODE

BACKGROUND OF THE INVENTION

This invention relates to a spark plug for internal combustion engines, and more particulary to a small-sized spark plug having smaller dimensions as a whole than conventional ones.

The spark plugs now in general use have a large outer diameter (the diameter of the threaded portion of spark plugs now in use is generally 14 mm). This fact becomes a serious obstacle to the design of the installation for the water cooling system and valves at the head portion of an engine when it is intended to make smaller-sized and lighter spark plugs or spark plugs capable of multipoint ignition.

FIG. 5 shows the main part of a spark plug which is now in general use. In the spark plug shown in the Figure, gaseous discharge occurs in the air-gap (a) formed by a center electrode 1 and an earthed electrode 2*a*. If the size of this type of spark plug is reduced in accordance with the object of the invention, the distance (b) between the center electrode 1 and the housing 2 is shortened. It is undesirable, however, for the distance (b) to be made too short, because this would mean creation of a spark passage (d) directly between the center electrode 1 and the housing 2 as well as the a spark passage (c) in the normal spark gap and this would in turn cause a spark between the center electrode 1 and the housing 2 along the surface of the insulator which might result in inferior ignition efficiency, misfiring and fluctuations in combustion.

On the other hand, if the outer diameter of a spark plug is made smaller by reducing both the outer diameter of a center electrode and the thickness of the insulator, and by employing creepage discharge as is described in Japanese Patent Publication No. 1496/1972 in place of the gaseous discharge so that sparking may occur directly from the center electrode to the housing along the insulator surface, several channels are formed on the surface of the insulator due to abrasion by sparks; namely, what is called a "chanelling phenomenon" is produced. When the channels are caused on the insulator surface by virtue of this channelling phenomenon, sparks travel along the channels and the area in which sparks came into contact with a mixture gas is reduced, which leads to deterioration of ignition efficiency. Furthermore as the channelling phenomenon progresses, the channels on the insulator surface between the center electrode and the housing take the shape of bores through which sparks travel so that they have substantially no contact with the mixture gas. This phenomenon thus disadvantageously results in a remarkable reduction in durability of the spark plug as well as failure to cause ignition.

SUMMARY OF THE INVENTION

Accordingly it is an object of the invention to solve the above-described problems of the conventional spark plug and to provide a small-sized spark plug having a spark gap between the terminal end portion of a center electrode and the opposed terminal end portion of an earthed electrode along the surface of an insulator and in the axial direction of the spark plug, both the distances between the surface of the insulator and each of the terminal end portions of the electrodes and a spark gap between the terminal end of the earthed electrode and the terminal end of the center electrode being restricted to have values within predetermined ranges.

It is another object of the invention to solve the above-described problems of the conventional spark plug and to provide a small-sized spark plug with a spark gap between the terminal end of a center electrode and the opposed terminal end of an earthed electrode along the surface of an insulator having a recessed portion, the depth of the recessed portion provided on the surface of the insulator and the spark gap between both forward ends being restricted within predetermined ranges.

A spark plug according to the first aspect of the invention (hereinunder referred to as "a first spark plug") comprises: a center electrode including an axial portion which is surrounded by an insulator, namely an insulation layer, and a terminal end portion which is to act as a spark generation portion; and an earthed electrode including a terminal end portion which is located in a position opposite the terminal end portion of the center electrode in the axial direction along the surface of the insulator layer, a spark gap being defined in the space between the terminal end portion of the earthed electrode and the terminal end portion of the center electrode; characterized in that the shortest distance $\delta$ (mm) between each of the terminal end portions of both electrodes and the surface of the insulation layer and the distance $\delta$ (mm) between the terminal end portions of both electrodes have the following relationship:

$$\delta \geqq 0.25\ l, \text{ and } 0.8\ \text{mm} \leqq l \leqq 2.0\ \text{mm}.$$

A spark plug according to the second aspect of the invention (hereinunder referred to as "a second spark plug") comprises: a center electrode including an insulator, namely, an insulation layer having a recessed portion on the surface thereof, a shaft portion covered by the insulation layer, and a terminal end portion functioning as a spark generation portion; and an earthed electrode including a terminal end portion which is located in a position opposite to the terminal end portion of the center electrode in the axial direction along the surface of the insulator layer, a spark gap being defined in the space between the terminal end portion of the earthed electrode and the terminal end portion of the center electrode. In the second spark plug, the depth $\delta$ (mm) of the recessed portion provided on the surface of the insulation layer and the width l (mm) of the recessed portion have the following relationship:

$$\delta \geqq 0.25\ l, \text{ and } 0.8\ \text{mm} \leqq l \leqq 2.0\ \text{mm}$$

In order to effect the research of the channelling phenomenon, there is provided a disc insulator having one projection or recessed portion 2 mm in width on the surface thereof or a disc insulator having a flat surface. Two electrodes are disposed on the surface of the insulator which electrodes are in contact with the surface with an interval of 2 mm therebetween along the projection or the recessed portion. In this state a spark is generated between both electrodes and the spark influences caused in the surface state of the insulator exerted on the degree of channelling phenomenon (the maximum depth of a channel caused by virtue of channelling phenomenon is adopted as a representative), discharge voltage and the generation rate of creepage discharge are shown in FIG. 3. As is clear from FIG. 3, the degree of channeling phenomenon becomes large when the insulator surface corresponding with the sparking position has a convex form, and becomes small when the recessed portion is formed on the insulator surface. When the depth of the recessed portion is 0.5 mm, chanelling phenomenon is scarcely caused. The discharge voltage is at its lowest when the insulator surface is flat, and becomes higher with the increase of the height of the projection or the depth of the recessed portion. The generation ratio of creepage discharge is approximately 100% when the insulator has a projection and a flat surface, and decreases when the insulator has a recessed portion; as the depth of the depression becomes greater, the generation ratio of creepage discharge decreases and the ratio of gaseous descharge increases. Since the discharge voltage is higher in gaseous discharge than in creepage discharge, the discharge voltage is higher when the insulator has a recessed portion than when it has a flat surface. In the case shown in FIG. 3, substantially no channeling is produced when the spark gap is 2 mm and the depth of the recessed portion of the insulator is 0.5 mm, but if the spark gap is shortened, a shallow recessed portion may be enough for preventing the occurrence of channeling. The present inventor has found as a result of experiments that the relationship between the length l of the spark gap and the depth of the recessed portion on the insulator surface (m) is represented approximately by $m = 0.25\,l$. Though the spark gap is about 0.8 to 1.1 mm in the ordinary spark plug, if it is made 0.8–2 mm in consideration of ignition efficiency, deterioration of the plug can be reduced to a permissible extent in practical use by providing a recessed portion which satisfies the condition of $m \geqq 0.25\,l$. In a first spark plug according to the invention, in place of providing a recessed portion of a predetermined depth on the surface of an insulator in a position corresponding to the spark gap of the spark plug, a clearance is provided between each of the terminal ends of the two electrodes which define the spark gap and the surface of the insulator. The dimension of the space, namely, the shortest distance ($\delta$) between either of the terminal end portions of the two electrodes and the insulator surface is set such as to meet the condition that $\delta \geqq 0.25\,l$, whereby the generation ratio of creepage discharge is decreased to the minimum permissible and the ratio of gaseous discharge is increased, and a small-sized plug in which the above-described problems are solved thus being obtained. The thickness of the insulation layer at the position of the spark gap is set within a predetermined range in order to produce a spark only in the spark gap. This range varies depending upon such factors as discharge voltage and the width of a spark gap, and is preferably 0.8 to 1.2 mm.

In the second spark plug according to the invention, the spark gap is set at 0.8 to 2 mm in consideration of ignition efficiency, and a recessed portion having the width (l) of 0.8 to 2 mm is provided on the insulation layer adjacent this spark gap. By determining the depth ($\delta$) of the recessed portion such as to meet the condition that $\delta \geqq 0.25\,l$, the deterioration of the insulator is reduced to a permissible degree for practical use and a good generation ratio of gaseous discharge is obtained.

In order to produce a spark only in the spark gap in the structure of the second spark plug shown in FIG. 6 in which an insulation layer extending in the axial direction is is provided adjacent to the spark plug, the insulation layer is formed with a thickness which falls within a predetermined range. This range varies depending upon such factors as discharge voltage and the length of a spark gap, and is preferably 0.8 to 1.2 mm.

The above and other objects, features and advantages of the present invention will become clear from the following description of the preferred embodiments thereof, taken in conjunction with the accompanying drawings.

DESCRIPTION OF THE PREFERRED EMBODIMENTS

Figure 1:
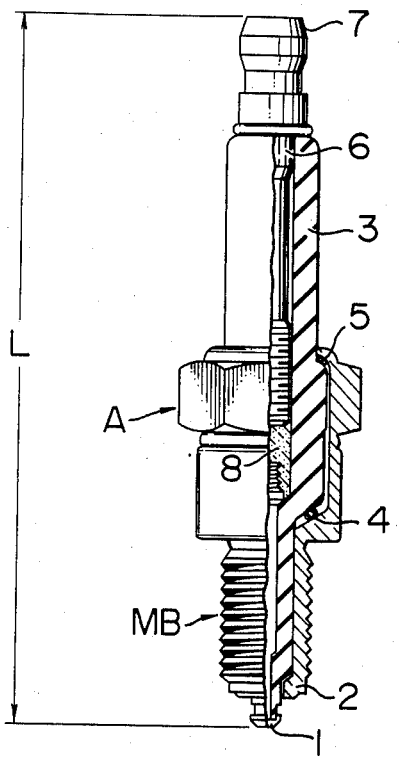
FIG. 1 is a partial sectional elevational view of the outline of first and second small-sized spark plugs according to the invention.

The preferred embodiments of a spark plug according to the invention will be explained with reference to the accompanying drawings. In an embodiment of the first spark plug shown in FIG. 1, the referential numeral 1 denotes a center electrode formed of a metal which has heat resistance, corrosion resistance and conductivity and is generally formed of an electrode material such as 2% Cr - Ni alloy. The central electrode 1 is composed of a columnar shaft portion and a terminal end portion which is bonded to the shaft portion by, for example, spot welding. The referential numeral 2 represents a cylindrical housing 2 and 3 an insulator formed of alumina porcelain. At the center of the insulator 3 a shaft hole is provided and the housing 2 is secured to the insulator 3 in a sealing state by an annular sealing packing 4 and caulking ring 5. A center shaft 6 formed of a carbon steel is inserted into the shaft hole of the insulator 3. A terminal 7 formed of brass or the like is screwed and secured to the head portion of the center shaft 6. The referential numeral 8 denotes a conductive glass sealing layer which is sealed into the shaft hole of the insulator 3. The sealing layer 8 electrically connects and fixes the center electrode 1 to the center shaft 6.

Figure 2A:
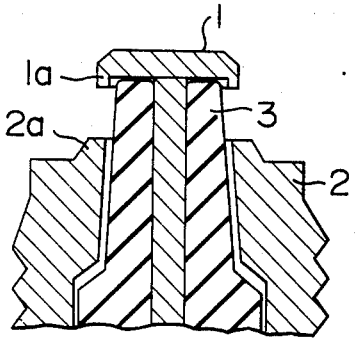
FIG. 2A is a sectional view of the main part of a first small-sized spark plug according to the invention.
Figure 2B:
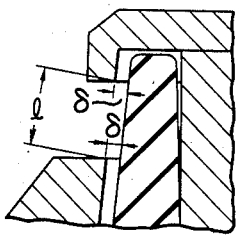
FIG. 2B is an enlarged view of the main part shown in FIG. 2A.
Figure 3:
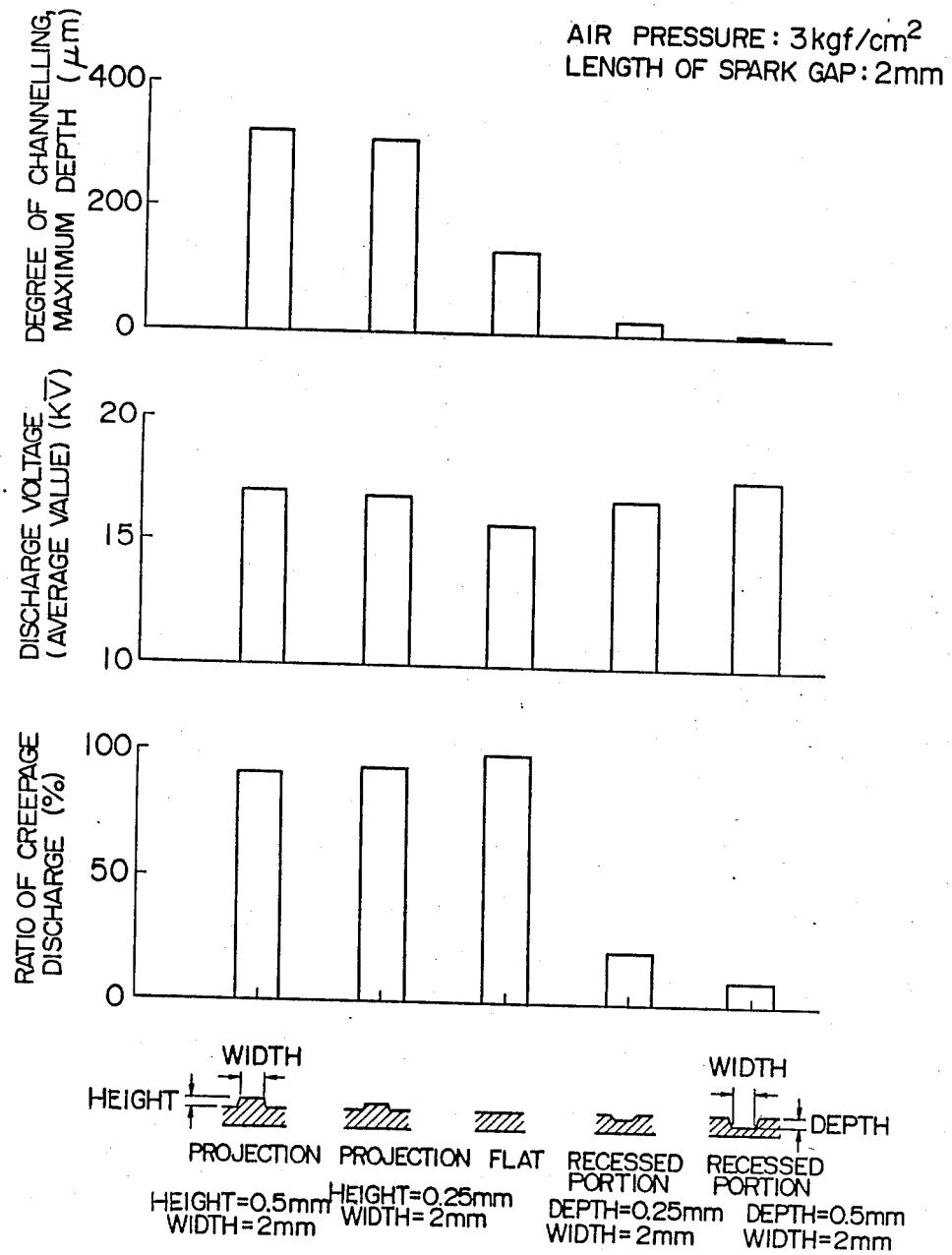
FIG. 3 is a graph showing the relationship between, on one hand, the surface state of an insulator of a creepage discharge type plug and, on the other hand, the degree of channelling, discharge voltage and the generation ratio of creepage discharge.

Referring to FIGS. 2A and 2B which illustrate sectional views of electrodes which form the main part of the first spark plug, the columnar shaft portion of the center electrode is surrounded by the annular insulator 3 which is 0.8 to 1.2 mm in thickness at a position adjacent to a spark gap. The diameter of the shaft portion is preferably 0.8 to 1.2 mm. At the end portion of the center electrode a cap-like end portion is bonded to the end portion of the columnar shaft portion by, for example, spot welding, and on this cap-like end portion an annular terminal end portion, namely, a protrusion 1*a* is provided in such a manner as to be adjacent to the surface of the insulator 3 and to be kept outwardly apart δ (mm) from the surface thereof in the radial direction. The outer diameter of the cap-like end portion is 3.4 to 4.6 mm, and is identical with that of the annular protrusion (that is, terminal end portion 1*a*), the thickness of the terminal end portion 1*a* in the radial direction being 0.3 to 0.5 mm and the height 0.3 to 0.5 mm. The protrusion 1*a* is provided to be coaxial with respect to the shaft portion. The terminal end portion of the housing 2, namely, a protrusion 2*a* is formed annularly which is spaced apart l (mm) from the protrusion 1*a* in the axial direction and spaced apart δ (mm) from the surface of the insulator. This housing 2 serves as an earthed electrode and the space (l) between the protrusion 1*a* and the protrusion 2*a* defines the length of the spark gap. The value of l is preferably within the range from 0.8 mm to 2.0 mm, and the value of δ is determined such as to meet the condition that $\delta \geqq 0.25\ l$. The adoption of the above-described structure achieves a spark plug of much smaller dimension than conventional one now in general use, that is, the threaded portion (MB) of the housing can be reduced to M8 (8 mm in diameter) and the width across flats of the hexagonal portion (A) can be reduced to 14 mm in the case of the present invention.

The application of a high voltage from the terminal 7 to the center electrode 1 through the center shaft 6 and the seal 8 causes spark discharge between the terminal end portion 1*a* of the center electrode and the terminal end portion 2*a* of the earthed electrode. At this time, if the shortest distance (δ) between the terminal end portion (1*a* or 2*a*) and the surface of the insulator 3 is small in comparison with the dimension (l) of the spark gap, a spark travels along the insulator surface, i.e. creepage discharge is caused, and channeling phenomenon occurs. In the case of $\delta \geqq 0.25\ l$ and 0.8 mm $\leqq l \leqq 2.0$ mm, however, the generation ratio of creepage discharge is small and that of gaseous discharge is large, which greatly diminishes the possibility of channel phenomenon occurring and brings about a spark plug suitable for practical use.

Figure 4A:
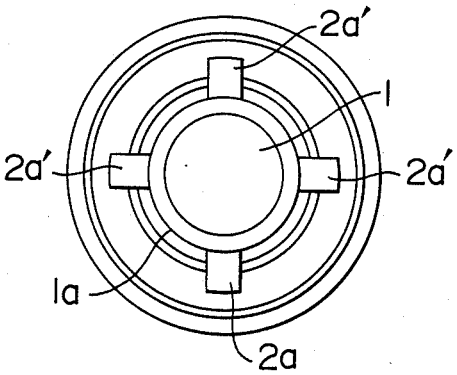
FIGS. 4*a* and 4*b* are elevational views of another embodiment of a first small-sized spark plug and a sectional view of the main part thereof, respectively.
Figure 4B:
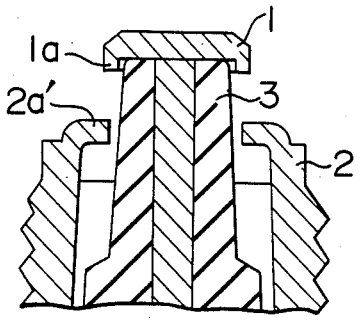
Figure 5:
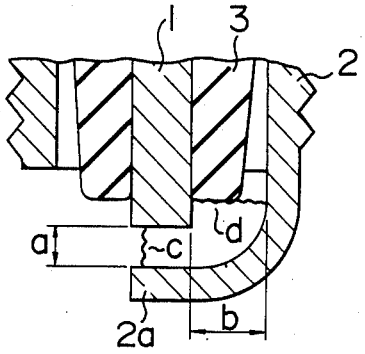
FIG. 5 PRIOR ART
FIG. 5 is a sectional view of the main part of a spark plug in the prior art.

FIGS. 4*a* and 4*b* are respectively a plan view of another embodiment of a first spark plug and a sectional view of the main part thereof. In the embodiment shown in the FIGS., the terminal end portions 2*a*' of the earthed electrode comprising four projections which project from the housing body toward the insulator. The other features are the same as in the embodiment shown in FIG. 2. This embodiment having an earthed electrode of a multi-polar structure exhibits advantageous effects similar to the first embodiment having an annular earthed electrode.

Figure 6:
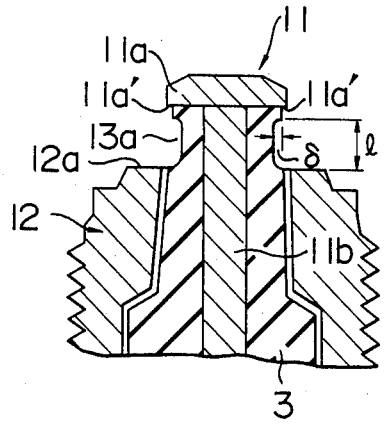
FIG. 6 is a sectional view of the main part of an embodiment of a second small-sized spark plug having a recessed portion on the surface of the insulator.

FIG. 6 is an enlarged sectional view of the main part of the second spark plug according to the invention in which a recessed portion is provided along the surface of the insulator. In a center electrode 11, a shaft portion 11*b* which is 0.8 to 1.2 mm in diameter and extends in the axial direction is bonded to a cap-shaped terminal end portion 11*a* protruding orthogonally with respect to the axis of the shaft portion 11*b* by, for example, spot welding. The outer diameter of the terminal end portion 11*a* is preferably in the range of 3.4 to 4.6 mm and the thickness is preferably 0.8 to 1.2 mm. The end portion of a housing 12, which is to serve as the terminal end portion 12*a* of an earthed electrode, is provided at a position inwardly spaced apart from the terminal end portion 11*a* in the axial direction by a distance of 0.8 to 2.0 mm, which equates to the desired dimension of a spark gap, and at a position radially outside of the edge of the end portion 11*a*. An annular insulation layer is provided to be in contact with the terminal end portion 11*a* of the center electrode and to surround the shaft portion 11*b*. A recessed portion 13*a* is formed on the surface of the insulation layer, that is, formed at a position in the vicinity of the spark gap defined between the end portion 11*a* of the center electrode and the end portion 12*a* of the earthed electrode. The width of the recessed portion 13*a* formed on the surface of insulator 13 is $0.8 \leqq l\ 2.0$ mm, and the depth δ is $\delta \geqq 0.25\ l$. The recessed portion 13*a* extends from the end portion 12*a* of the earthed electrode to a position spaced axially apart 0.3 to 0.5 mm from the axially inner surface of the end portion 11*a* of the center electrode. The inner surface portion 11*a*' of the forward end portion 11*a* of the center electrode slightly radially protrudes from the insulator surface which is in contact with the inner surface portion 11*a*'. The thickness of the insulator 13 is preferably 0.8 to 1.2 mm at the end portion of the earthed insulator.

In the structure of this embodiment of a spark plug having a recessed portion on the surface of an insulator, the diameter of the threaded portion of the housing can be reduced to M8 (8 mm in diameter) and the width across flats of the hexagonal portion A can be reduced to 14 mm, these dimensions being smaller than those of the conventional spark plug.

Sparks discharge between the end portion 11*a* of the center electrode and the end portion 12*a* when a high voltage is applied to the center electrode 1 through the center shaft 6 and the seal 8. If there is no recessed portion 13*a* in this case, the spark travel on the surface of the insulator 13, namely, creepage discharge is caused; however, since in a second spark plug according to the invention, the recessed portion 13*a* is formed on the surface of the insulator 13 which extends substantially over the entire width of the spark gap, the ratio of gaseous discharge becomes extremely large, while the generation ratio of creepage discharge becomes small. Thus a small-sized spark plug suitable for practical use is obtained.

Figure 7:
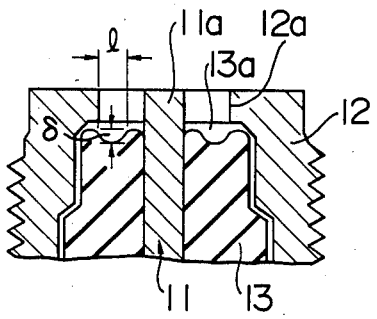
FIG. 7 a sectional view of the main part of another embodiment of a second small-sized spark plug.

FIG. 7 is a sectional view of the main part of another embodiment of a spark plug having a recessed portion on the surface of an insulator. While the embodiment shown in FIG. 6 has a structure in which the end portion 11*a* of the center electrode 11 is axially opposed to the end portion 12*a* of the earthed electrode 12 approximately in parallel with the axis thereof in such a manner that a spark travels approximately in parallel to the axis, in the embodiment shown in FIG. 7, the end portion 11*a* of the center electrode 11 and the end portion 12*a* of the earthed electrode 12 are opposed orthogonal to the axis of the center electrode with a space, thus defining a spark gap extending in the orthogonal direction to the axis. A spark thus travels substantially in the orthogonal direction to the axis. The length of the spark gap preferably falls within the range of 0.8 mm to 2.0 mm. The recessed portion 13*a* is provided on the terminal end portion of the annular insulator 13 which extends in the radial direction along the spark gap. The width (l) of the recessed portion 13*a* measured from the redially inner edge of the terminal end portion 12*a* of the earthed electrode 12 is 0.8 mm to 2.0 mm and the depth (δ) is $\delta \geqq 0.25\ l$. Preferably the terminal end portion 11*a* of the center electrode 11 has the same configuration as the main part (i.e. the shaft portion) of the center electrode 11 and protrudes 0.8 to 1.2 mm axially outwardly from the end portion of the insulator which surrounds the shaft of the center electrode. The other features are the same as the embodiment shown in FIG. 6.

Figure 8A:
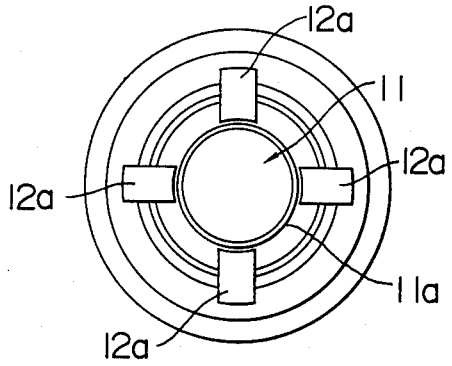
FIG. 8A is a plan view of an embodiment of a small-sized spark plug according to the second smallsized spark plug of the invention.
Figure 8B:
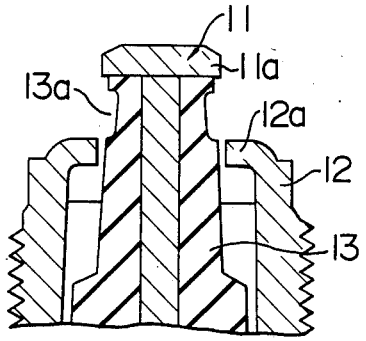
FIG. 8B is a sectional view of the main part of the embodiment shown in FIG. 8A.

Referring now to FIGS. 8A and 8B, which show a further embodiment of the second spark plug according to the invention, this embodiment has a quadri-polar earthed electrode 12*a* in place of the annular earthed electrode shown in FIG. 6. The other features are the same as the embodiment shown in FIG. 6. In this way, the earthed electrode may have either a multi-polar structure or a unipolar structure.

Figure 9:
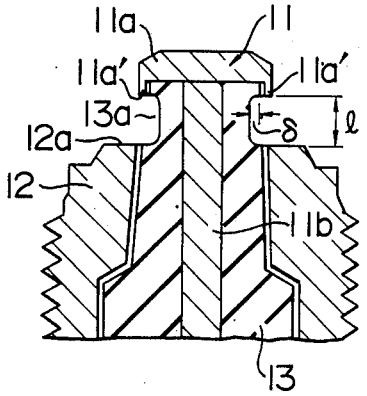
FIG. 9 is a sectional view of still another embodiment of a second small-sized spark plug according to the invention.

FIG. 9 shows a still further embodiment of the second spark plug according to the invention. In this embodiment, an annular protrusion 11*a'* is provided on the cap-like terminal end portion 11*a* of the center electrode 11, and the width l of the recessed portion 13*a* is approximately the same as the width of the spark gap, 0.8 mm to 2.0 mm.

The structures of the first and second spark plugs according to the invention bring about the following advantages:

(a) The size of a spark plug can be made smaller by setting the diameter of the shaft portion of the spark plug to have a value of 0.8 to 1.2 mm, which is smaller than that in the prior art, and by making it a creepage discharge type spark plug. Tables 1 and 2 ahow the size of a spark plug according to the invention having center electrodes with a 1 mm diameter shaft portion while being compared with the size of a spark plug now in general use.

TABLE 1

| | A (mm) | B (mm) | L (mm) |
|---|---|---|---|
| Spark plug now in general use | 14 | 20 | 80 |
| Spark plug according to the invention | 8 | 14 | 60 |

TABLE 2

| Spark plug according to the invention | Areal ratio of threaded portion | Areal ratio of hexagonal portion |
|---|---|---|
| Spark plug now in general use | 33% | 49% |

As is obvious from the tables, the invention makes it possible for the diameter of the threaded portion which is 14 mm in a spark plug of the prior art to be reduced to 8 mm, and the area of the threaded portion of a spark plug and the hexagonal portion to be reduced to 33% and 49%, respectively, in comparision with those in the prior art. A spark plug according to the invention can be greatly reduced in dimension as a whole as compared with spark plugs of the prior art. As a result, it is possible to make the plug screwing portion of a cylinder head smaller, and hence the engine itself can be minituarized. In the case of four-valve type engines, therefore, the dimensions of a spark plug according to the invention are very favorable from the viewpoint of design.

(b) Since both the distance l (the length of a spark gap) between the terminal end portion of the center electrode and that of the earthed electrode and the shortest distance δ (space) between the terminal end portions and the surface of the insulator are set appropriately, the generation ratio of creepage discharge caused on the insulator surface and the possibility of channeling phenomenon can be reduced, which channeling phenomenon has hitherto been considered unavoidable in a creepage discharge type spark plug, with the result that a spark plug suitable for practical use can be obtained.

(c) In the second spark plug according to the invention having the recessed portion on the surface of the insulator where spark discharge is caused, the generation ratio of gaseous discharge is greater than that of creepage discharge, and the channeling phenomenon which is unavoidable in a creepage discharge type spark plug is reduced to a great extent, whereby a spark plug suitable for practical use can be obtained.

While there has been described what are at present considered to be the preferred embodiments of the invention, it will be understood that various modifications may be made thereto, and it is intended that the appended claims cover all such modifications as fall within the true spirit and scope of the invention.

What is claimed is:

1. A small-sized spark plug for internal combustion engines comprising:

a center electrode having a longitudinal axis extending through the center of the electrode and a shaft portion surrounded by an insulator layer and a terminal end portion adapted to act as a spark generation portion; and an earthed electrode having a terminal end portion which is spaced in the direction of said axis apart from and is opposite to the terminal end portion of the center electrode so that the whole of a spark gap is defined along a surface of the insulator layer, the shortest distance δ between each end portion of said two electrodes and the surface of said insulation layer and the distance l between said forward end portions of said two electrodes having the following relationship:

$$\delta \geqq 0.25\ l, \text{ and } 0.8\ \text{mm} \leqq l \leqq 2.0\ \text{mm},$$

said plug reduces the deterioration in ignition efficiency caused by creeping discharge channelling phenomenon during operation of the plug.

2. A small-sized spark plug according to claim 1, wherein said terminal end portion of said earthed electrode is formed annually and coaxially with respect to said shaft portion of said center electrode.

3. A small-sized spark plug according to claim 1, wherein said terminal end portion of said earthed electrode is provided with a plurality of protrusions which project from a housing body constituting said earthed electrode toward the insulator layer.

4. A small-sized spark plug according to claim 1, wherein said terminal end portion is a cap-like end portion bonded to the end portion of said shaft portion of said center electrode, said terminal end portion adapted to act as a spark generation portion being of a ring shape provided along and projected from the outer periphery of said cap-like end portion.

5. A small-sized spark plug according to claim 1, wherein said insulation layer surrounding said shaft portion of said center electrode is annular and 0.8 to 1.2 mm in thickness.

6. A small-sized spark plug for internal combustion engines comprising:

a center electrode having a longitudinal axis extending through the center of the electrode and a shaft portion surrounded by an insulator layer and a terminal end portion adapted to act as a spark generation poriton; and an earthed electrode having a terminal end portion which is spaced in the direction of said axis apart from and is opposite to the terminal end portion of the center electrode so that the whole of a spark gap is defined along a surface of the insulator layer, said surface of the insulator layer being provided with a recessed portion in the vicinity of the spark gap, said recessed portion having a width l and depth δ having the following relationship:

$$\delta \geqq 0.25\ l, \text{ and } 0.8 \text{ mm} \leqq l \leqq 2.0 \text{ mm},$$

said plug reduces deterioration in ignition efficiency caused by creeping discharge channeling pehnomenon during operation of the plug.

7. A spark plug according to claim 6, wherein said spark gap extends in parallel to the axis of said shaft portion of said center electrode.

8. A spark plug according to claim 6, wherein said spark gap extends in the orthogonal direction with respect to the axis of said shaft portion of said center electrode.

9. A spark plug according to claim 9, wherein said terminal end portion of said center electrode has the same configuration as said shaft portion of said center electrode, and projects axially outwardly 0.8 to 1.2 mm from said terminal end portion of an insulator which surrounds said shaft portion.

10. A spark plug according to claim 6, wherein said terminal end portion of said earthed electrode is formed annually and coaxially with respect to said shaft portion of said center electrode.

11. A small-sized spark plug according to claim 6, wherein said terminal end portion of said earthed electrode comprises a plurality of protrusions which project from a housing body constituting said earthed electrode toward said insulator layer.

12. A small-sized spark plug according to claim 6, wherein a cap-like terminal end portion is bonded to the end portion of said shaft portion of said center electrode, the surface portion which is adapted act as said spark generation portion being provided annularly along the outer peripheral portion of said cap-like terminal end portion, said surface portion slightly protruding from a terminal end of an insulator layer which surrounds said shaft portion of said center electrode.

* * * * *